United States Patent [19]

Chang

[11] 4,251,234

[45] Feb. 17, 1981

[54] HIGH INTENSITY IONIZATION-ELECTROSTATIC PRECIPITATION SYSTEM FOR PARTICLE REMOVAL

[75] Inventor: Ching M. Chang, Williamsville, N.Y.

[73] Assignee: Union Carbide Corporation, New York, N.Y.

[21] Appl. No.: 77,848

[22] Filed: Sep. 21, 1979

[51] Int. Cl.[3] ..... B03C 3/12

[52] U.S. Cl. ..... 55/2; 55/129; 55/133; 55/138; 55/150; 138/40; 138/44

[58] Field of Search ..... 55/2, 129, 133, 138, 55/150; 138/40–41, 44

[56] References Cited

U.S. PATENT DOCUMENTS

| | | | |
|---|---|---|---|
| 1,940,790 | 12/1933 | Diehl | 138/44 |
| 2,997,130 | 8/1961 | Nodolf | 55/133 X |
| 3,519,024 | 7/1970 | Johnson et al. | 55/418 X |
| 3,572,391 | 3/1971 | Hirsch | 138/40 |
| 3,645,298 | 2/1972 | Roberts et al. | 138/40 |
| 3,724,502 | 4/1973 | Hayner et al. | 138/41 |
| 3,841,568 | 10/1974 | Broad | 138/44 |
| 4,007,908 | 2/1977 | Smagghe et al. | 138/41 X |
| 4,074,983 | 2/1978 | Bakke | 55/138 X |
| 4,108,615 | 8/1978 | Satterthwaite | 55/2 |

FOREIGN PATENT DOCUMENTS

| | | | |
|---|---|---|---|
| 520710 | 3/1931 | Fed. Rep. of Germany | 55/129 |
| 2302547 | 7/1974 | Fed. Rep. of Germany | 138/40 |
| 877056 | 11/1942 | France | 55/128 |

*Primary Examiner*—Kathleen J. Prunner
*Attorney, Agent, or Firm*—Lawrence G. Kastriner

[57] ABSTRACT

In the removal of particles from a gas stream by high intensity ionization and then collection by electrostatic precipitation, flow of the electrostatically charged gas entering the precipitation is restricted in a non-uniform manner.

13 Claims, 24 Drawing Figures

HIGH INTENSITY IONIZATION-ELECTROSTATIC PRECIPITATION SYSTEM FOR PARTICLE REMOVAL

BACKGROUND OF THE INVENTION

This invention relates to a method of and apparatus for removal of fine particles from a gas stream, for example fly ash particulates from the gaseous emissions of a coal-fired electrical generating power station.

Along with rapid industrial growth over the last two decades, there has been an alarming increase in the discharge of harmful pollutants into the environment. Unfortunately, the necessary pollution abatement technology to minimize, or eliminate the discharge of industrial waste material and its harmful effects has not kept pace with overall technological growth. To stimulate the needed pollution control innovations, stringent standards have been imposed on industry requiring the reduction or total elimination of particulate discharge in the atmosphere.

Schwab et al U.S. Pat. Nos. 4,093,430 and 4,110,086 describe a recent technological advancement in air pollution control, in particular the removal of fine particles of 0.1 microns and 3.0 microns diameter. These patents describe a high intensity ionization system (hereafter referred to as "HII unit" or "HII stage") wherein a disc-shaped discharge electrode is inserted in the throat of a Venturi diffuser. A high D.C. voltage is imposed between the discharge electrode or cathode and the Venturi diffuser, a portion of which acts as an anode. The high voltage between the two electrodes and the particular construction of the cathode disc produces a stable corona discharge of a very high intensity. Particles in the gas which pass through the electrode gap of the Venturi diffuser are charged to very high levels in proportion to their sizes. The entrained particulated are field charged by the strong applied field and by ion impaction in the region of corona discharge between the two electrodes. The high velocity of the gas stream through the Venturi throat reduces the accumulation of space charge within the corona field established at the electrode gap and thereby improves the stability of the corona discharge between the two electrodes.

In the further HII improvement of Satterthwaite, U.S. Pat. No. 4,108,615, jets of cleaned air are introduced along the anode wall to prevent particle deposition thereon and to mechanically remove excess deposits from the anode, thus preventing the onset of back corona. Most effective operation of the HII unit requires high velocity gas flow through the throat region on the order of 75 ft/sec. The gas velocity is then reduced in the exit nozzle to a lower value of about 20 ft/sec. (average based on the exit face area of the nozzle). It is common practice to utilize an array of HII devices upstream of an otherwise standard electrostatic precipitator (hereinafter referred to as "ESP unit" or "ESP stage") as shown for example in the aforementioned Satterthwaite patent. In that illustrative arrangement, the HII stage utilizes a 3 (horizontal)×5 (vertical) array of HII devices upstream of the ESP unit. It is apparent that such an arrangement essentially results in the introduction of multiple relatively high velocity gas jets from the HII stage. For the electrostatic precipitator to function properly, relatively low gas velocities are normally required, in the range of 5 ft/sec., and further the gas load should be evenly distributed across the inlet cross-section area of the electrostatic precipitator unit. Accordingly, most effective performance of the ESP unit requires distribution of the multiple gas jet discharges from the HII unit so that gas is uniformly directed to the ESP unit. The ESP unit comprises a series of parallel spaced plates and a multiplicity of wires equally spaced between each pair of adjacent plates and positioned at intervals in the longitudinal flow direction from the ESP inlet to a gas discharge end and oriented with the wire length normal to the direction of gas flow.

One prior art method to distribute the multiple source gas from the HII stage to the ESP stage has been to utilize a suitable plenum chamber between the two stages. The suitable chamber for such purposes must be sufficiently large to allow the high velocity jets to merge so that the gas flow essentially becomes uniform throughout the available cross-sectional area. Under those conditions, the uniformly distributed gas flows into the inlet of an ESP unit and thereby is uniformly processed by the ESP unit. Although incorporating a suitably large chamber between the HII stage and ESP stage can solve the fluid flow distribution problem, such a large chamber is detrimental from a space charge standpoint. The purpose of the HII unit is to develop high charge on the small particulate matter to be removed. Once that charge is imparted to the particles, it is highly desirable for those particles to be immediately subjected to the collector plates associated with the ESP unit. Without immediate exposure to collection plates, the space charge associated with the highly charged particles (hereinafter referred to as "charged dust cloud") has undesirable tendencies to either degrade charge level or cause collection of the dust particles on available surfaces in the intermediate plenum chamber. Also flow of such a highly charged dust cloud can cause buildup of non-uniformity within the dust cloud which is deterimental to most effective collection of the dust particles in the ESP stage.

It appears from the foregoing that the need for a large chamber for effective flow distribution and a small chamber to minimize space charge problems are conflicting requirements for a highly efficient HII-ESP system.

An object of this invention is to provide an improved high intensity ionization-electrostatic precipitation system for separation of particles from gas streams.

Another object is to provide an improved gas flow distribution system between the high intensity ionizer and electrostatic precipitator stages of a particulate collection system.

A further object is to provide an improved HII-ESP gas flow distribution system which does not require a large intermediate chamber.

An additional object is to provide an improved HII-ESP gas flow distribution system between the two stages in which deposition of the dust particulate matter is minimized.

A still further object is to provide an improved HII-ESP gas flow distribution system between the two stages in which the fluid pressure drop in the direction of gas flow is minimized.

Other objects and advantages will be apparent from the ensuing disclosure and appended claims.

SUMMARY

This invention relates to a method and apparatus for separating particles from a gas by high intensity ionization and then electrostatic precipitation of the particles.

In its broadest method aspect, the invention relates to a method for removing particles from a gas stream in which the particles entrained in the gas stream are electrostatically charged by passage through a flow restricted high intensity discharge throat-shaped region and thereafter passed through an enlarged cone-shaped discharge region. A multiplicity of such throat-shaped and enlarged cone-shaped discharge regions are transversely positioned in the gas flow path and spaced from each other such that each particle passes through one throat-shaped and one cone-shaped region. The electrostatically charged particles are thereafter collected in a downstream plate-wire electrode type of electrostatic precipitation step. More specifically the method of this invention comprises restricting the flow of the electrostatically charged gas stream entering the electrostatic precipitation step in a non-uniform manner normal to the gas flow direction such that the open area of the flow restriction is between 5% and 50%, with the effective diameter of the flow restriction being between ½ and 2 times the diameter of the enlarged cone discharge. The electrostatically charged gas stream flow restriction in the longitudinal centerline region of the flow restriction is at least as high as the flow restriction in the circumferential region of the flow restriction.

The broadest apparatus aspect of this invention includes a multiplicity of high intensity ionizers each comprising a tubular Venturi means with a throat section having a disc-shaped member as a cathode positioned within the throat section, and the inner wall of the throat section as the anode. Each high intensity ionizer also includes an enlarged downstream cone-shaped discharge region, and the high intensity ionizers are transversely positioned in the gas flow path and spaced from each other such that each particle passes through one high intensity ionizer. An electrostatic precipitator is positioned with its inlet in gas flow relation with the discharge cones of the high intensity ionizers, and comprises parallel spaced plates with a multiplicity of wires equally spaced between each pair of adjacent plates. These wires are positioned at intervals in the longitudinal flow direction from the electrostatic precipitator inlet to a gas discharge end, and oriented with the wire length normal to the direction of the gas flow. More specifically, apparatus of this invention comprises flow restriction means between the high intensity ionizer discharge cones and the electrostatic precipitator inlet, being positioned normal to the gas flow direction and having between 5% and 50% open area, with the effective diameter of the flow restriction means between ½ and 2 times the diameter of the discharge cones. The percent open area of the flow restriction means in the longitudinal center line portion thereof is no higher than the percent open area in the circumferential portion of the flow restriction means.

As will be apparent from the ensuing disclosure, the gas flow restriction may be uniform in the radially outward direction from the longitudinal centerline region of the ESP inlet to the circumferential region. Alternatively, this flow restriction may be maximized in the longitudinal centerline region and progressively diminish in the radial direction to the circumferential region. From the apparatus standpoint, the gas flow restriction means may be in the form of a uniform grid which extends across the entire ESP inlet area or alternatively a multiplicity of individual flow restrictions, each paired to the cone mouth of an individual HII. For purposes of this invention, the "effective diameter" of the flow restriction means is based on the longitudinal centerline of HII enlarged cone discharge as its center, and is only sufficiently large to include the outermost extremities of all intersections of members forming the gas flow restriction means.

This invention equalizes the relatively high velocity gas jets exiting from the HII units to a relatively low velocity, uniform, gas flow entering the inlet for the ESP unit. The gas flow distribution function is performed with a minimum of excess fluid pressure drop and without adverse effects on the space charge problem, that is, without causing localized discharge of the charged dust particles.

BRIEF DESCRIPTION OF THE DRAWINGS

FIG. 7(*b*) is an end view of screen means suitable for use as the individual flow restriction means of FIG. 7(*a*).

FIG. 7(*c*) is an end view of spiral means also suitable for use as the individual flow restriction means of FIG. 7(*a*).

FIG. 8(*b*) is an end view of the FIG. 8(*a*) flow restriction rod-type mounting means taken along line A—A.

FIG. 8(*c*) is an end view of the FIG. 8(*a*) flow restriction rod-type mounting means taken along line B—B.

FIG. 9(*b*) is an end view of the FIG. 9(*a*) assembly taken along line A—A showing a triangular pitch array of the individual HII units.

FIG. 9(*c*) is an end view of the FIG. 9(*a*) assembly taken along line B—B showing the parallel channel flow path in the ESP unit, with vertical locations where gas velocities were recorded during flow distribution test.

FIG. 12(*b*) is an elevation view taken in cross-section along line A—A of the FIG. 12(*a*) screen.

DESCRIPTION OF PREFERRED EMBODIMENTS

Figure 1:
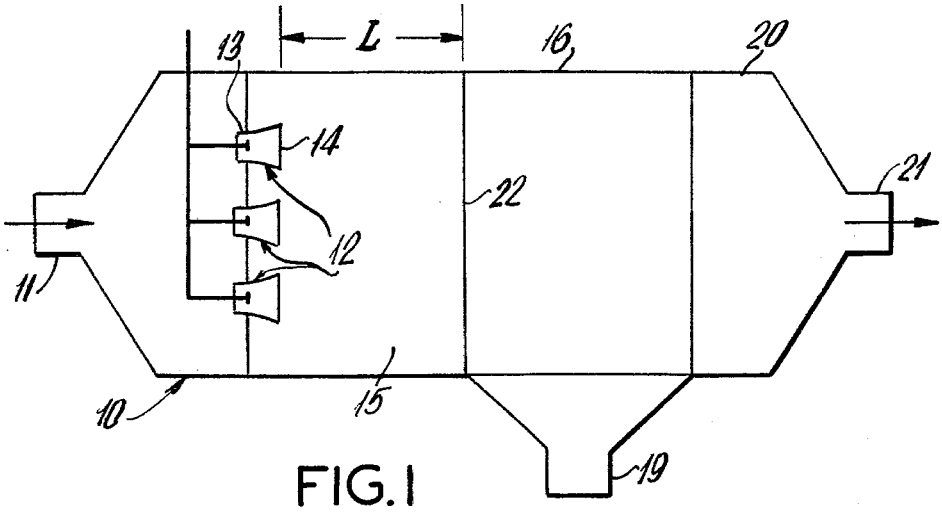
FIG. 1 is a schematic drawing taken in cross-section elevation of a highly intensity ionizer (HII) assembly followed by a plate-wire electrode type electrostatic precipitator assembly (ESP).
Figure 2:
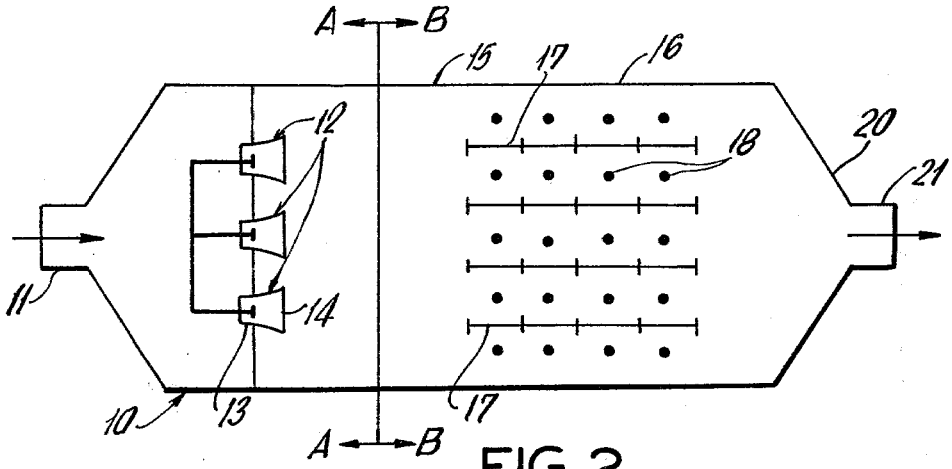
FIG. 2 is a cross-section plan view looking downwardly on the FIG. 1 HII-ESP assembly.

A typical dust collection configuration chamber 10 utilizing a high intensity ionizer stage combined with the electrostatic precipitator stage is illustrated in FIGS. 1 and 2. The chamber 10 has a suitable gas inlet tube 11 whereby the particulate laden gas is introduced and then passes through a stage or array 12 of high intensity ionizer units. The HII units are arranged in a regular array over the entire cross-sectional area of this system, so that for example as illustrated in FIGS. 1 and 2, a total of nine HII units are arranged in an array three horizontal by three vertical. Although the illustrated arrangement shows a square pitch pattern, the HII units can also be arranged on a triangular pattern and any pattern can utilize uniform or non-uniform spacing if desirable from space or other design considerations. As described in the aforementioned Schwab and Satterthwaite patents, the HII units accelerate the to-be treated gas through a Venturi nozzle 13 and thereby increase the gas velocity substantially in the throat area to about 75 ft/sec. Following passage through the throat area the gas is slowed in the exit mouth 14 but still has relatively high velocity of about 20 ft/sec. (average based on exit face area). During passage of the gas through the HII units, the high intensity electrostatic field serves to charge the particulate matter so that it can be later removed in downstream equipment.

The process gas discharges from the circular mouths associated with each HII unit as a series of essentially discrete gas jets into a chamber 15 separating the HII array 12 and ESP stage 16. Following ionization of the particulate matter in the HII stage 12, the charged dust cloud is carried by the gas flow to the electrostatic precipitator unit 16 for removal of the dust particles. The ESP unit 16 comprises a series of spaced vertical collection plates 17 and discharge electrodes 18 arranged such that the charged particles are attracted to the plates and collected. On an intermittent basis, the collected dust is removed from the plates 17 by suitable mechanical rapping or other means into a lower collection hopper 19. Following cleanup of the gas, the gas is collected in an exit chamber 20 and flows from the ESP unit by exit duct 21.

As previously explained, the electrostatic precipitator unit requires relatively low velocity gas flow (about 5 ft/sec.) in order to function properly. High gas velocities would reduce the migration of dust particles to the surfaces of the plates and additionally would erode the collected dust from the plate itself. Additionally, the functioning of the ESP unit at high efficiency requires essentially uniform gas flow across the entire cross-sectional area so that essentially all plate surfaces of the ESP unit are utilized effectively.

Figure 3:
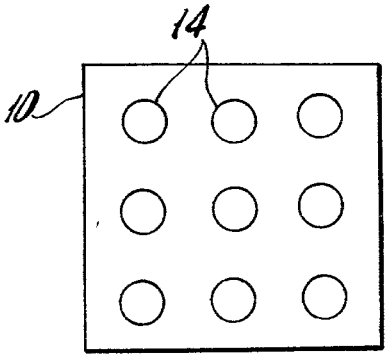
FIG. 3 is a cross-section end view of the FIG. 1 HII assembly taken along line A—A.
Figure 4:
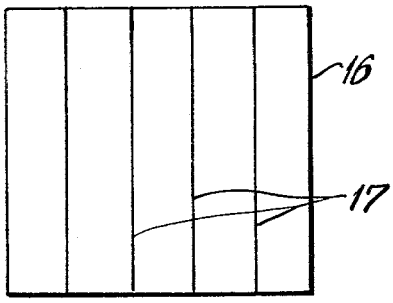
FIG. 4 is a cross-section end view of the FIG. 1 ESP assembly taken along line B—B showing only the collection plates.

FIGS. 3 (cross-section view A—A) and 4 (cross-section view B—B) serve to illustrate the gas flow patterns and obstructions in the HII unit and ESP unit, respectively. FIG. 3 illustrates that the essentially rectangular cross-sectional area of the HII unit includes a regular array of multiple flow points. Each HII exit mouth 14 represents a source of gas flow at the relatively high velocity, and the combination of the individual HII units 12 represents multiple flow sources preferably arranged in a regular pattern across the entire cross-sectional area. On the other hand, FIG. 4 illustrates that the entire ESP cross-sectional area is a series of vertical flow channels as formed by the spaced plates 17. From the standpoint of proper ESP functioning, the gas flow must be supplied to this unit uniformly across the entire cross-sectional area at a relatively low gas velocity.

It will be appreciated from the different geometric configurations of the HII unit and the ESP unit, that the flow distribution problem concerning the combination of the two units is difficult. As noted, the exit flow from the HII unit corresponds to essentially multiple gas jets arranged in a uniform pattern through the cross-sectional area. These multiple jets of relatively high gas velocity must be modified so that the gas flow becomes essentially uniform through the entire cross-sectional flow area.

One prior art approach to this flow distribution objective is to utilize connecting chamber 15 between the HII exit and ESP inlet. Such a flow distribution chamber 15 serves to allow the gas flows to merge and equalize across the entire cross-sectional area and thereby adopt essentially uniform flow velocity prior to entrance to the ESP unit. The length L of chamber 15 is a measure of the distance between the outlet of the HII array and the inlet 22 or leading plate edge for ESP unit 16. The flow distribution efficiency of the connecting chamber 15 may be represented as a function of the size or length of the chamber (assuming the same cross-sectional area for the HII and ESP units). This flow distribution efficiency improves as the size of the connecting flow chamber 15 is increased. In the limit, making the flow chamber sufficiently large would ensure that the multiple gas jets are equalized so that the gas is flowing uniformly across the entire cross section. This would ensure that the process gas is introduced uniformly as desired to the ESP unit. It will be evident that the use of such a flow distribution chamber may require significant space between the HII and ESP unit. For example, typically such connecting chamber 15 would need to be in the "L" range of about 4 to 6 feet with about 5 feet preferred for a size such that the flow distribution is acceptable across the flow area involved. Of course, utilizing such a relatively large chamber involves the obvious drawbacks of space considerations and cost considerations related to the size of the chamber.

There is another reason such large flow distribution chambers 15 are highly disadvantageous to the combination of an HII and ESP unit. The purpose of the HII stage is to charge the dust particles in the gas flow stream so that they can be later collected on the plates of the ESP stage. The high intensity ionizer unit is especially adapted to developing a high negative charge on the dust particles in the gas. As the negatively charged dust particles leave the expansion cones of the ionizers and enter the cavity between the HII and ESP units, they repel one another electrically causing the charged particles to move or explode towards the grounding walls of the cavity. Under steady state flow continuous a finite concentration of such highly charged particles will establish a negative electrostatic potential inside the cavity with the highest electrostatic potential located in its center. By way of graphical explanation, one may consider a plane perpendicular to the bulk gas flow and any line in that plane including the center of the chamber. The electrical potential profile can be described versus position on the line in question. The electrical potential profile is a maximum at the center and decreases from that point. Also, the electrical potential level increases with cavity size. The maximum center-point position electrostatic potentials may be represented as a curve showing increased potential with increasing chamber size.

As this highly charged dust cloud comes into contact with grounded structure, such as the chamber cavity, and especially if the grounded structures such as the cavity or leading edges of the plates have sharp edges, the electrostatic field in the vicinity of those sharp edges could be so concentrated as to exceed the breakdown field strength of the gas medium and thereby set off localized discharge. As a result of such discharge, positively charged ions are produced which tend to neutralize the negative charges on the dust particles. Such neutralization of the charge on the dust particles would counteract the charging function of the initial HII stage. The net result of such localized discharge or destruction of the charge on the dust cloud is subsequently lower than expected performance of the dust collection system. From an idealized standpoint, the best situation relative to the space charge problem would be to introduce the exiting flow from the HII cone mouths directly to the ESP collecting plates. This situation would not allow any significant electric field gradient to develop and would not allow any localized discharge of the field. It will be apparent that such a situation is not favorable due to the previously described flow distribution problem.

In addition to the foregoing, the space charge problem becomes more severe as the level of charge on the dust cloud is increased. Thus, increased charging in the HII array, as would otherwise be desirable for maximum system performance, would aggravate the space charge problem.

Figure 5A:
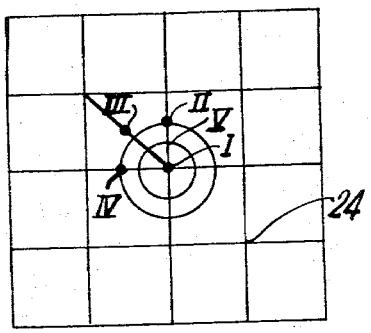
FIGS. 5(*a*), 5(*b*) and 5(*c*) illustrate the flow resistance characteristics for various gas paths between adjacent HII units.
Figure 5B:
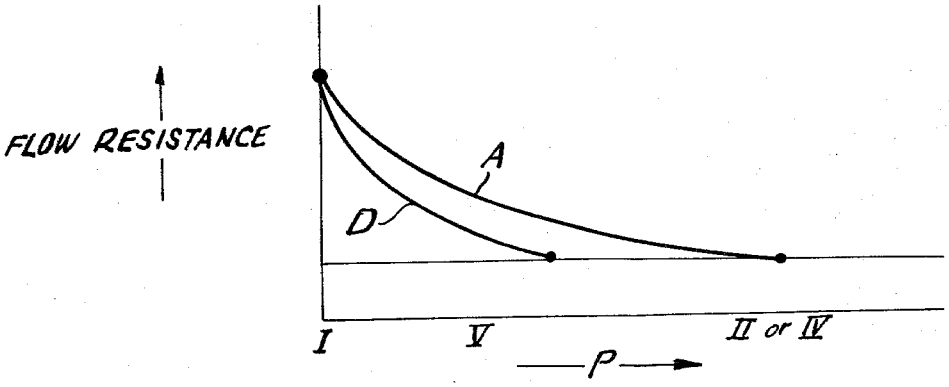
Figure 5C:
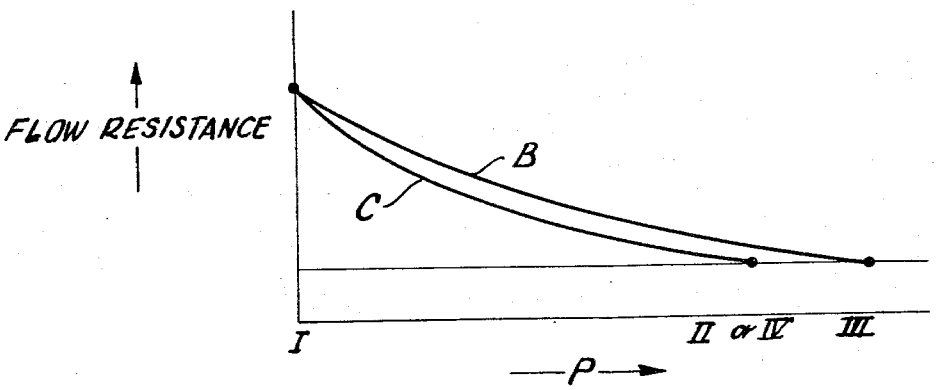

An approach of this invention to the two opposing requirements for the HII - ESP intermediate flow cavity is illustrated by the three parts of FIG. 5. The cross-sectional flow area associated with the flow chamber between the HII/ESP unit is illustrated by the FIG. 5 (*a*) schematic diagram. By way of illustration, the longitudinal axial centerline location of the HII array 12 of individual units is illustrated as the intersection of the vertical and horizontal lines as for example point 24. This means that for purposes of this illustration, there are nine HII locations each represented by one intersection. The following discussion is concerned with the middle HII unit which is represented by the middle intersection as shown on FIG. 5 (*a*). As location I corresponds to the longitudinal axial centerline of the middle HII unit in the 3×3 array. This invention utilizes a flow distribution device associated with each HII unit such that the flow resistance is non-uniform, arranged and constructed so that the maximum flow resistance is at that point where maximum gas flow needs to be diverted to equalize resultant gas flow. Considering position I as the centerline location of the particular HII unit, one may then consider positions eminating from that position to other positions in the cross-sectional flow area. On the diagram FIG. 5 (*a*) position II is the intermediate position between adjacent HII units of two separate horizontal rows. On the other hand, position IV is the intermediate position between adjacent HII units of two vertical columns of the array. On the same FIG. 5 (*a*) diagram, position III is the intermediate position on the diagonal between two adjacent HII units. One embodiment of the present invention utilizes a flow resistance means associated with each HII device so that the flow resistance (identified as ordinate in FIGS. 5 (*b*) and 5 (*c*)) is a maximum at the centerline position I and progressively decreases to a minimum (or zero) at the intermediate positions between adjacent HII units. In these FIGS. 5 (*a*) and 5 (*b*) location position is the abscissa "P". This concept is illustrated on attached curves A and D of FIG. 5 (*b*) where curve A represents the variation of flow resistance (FR) from a maximum to a minimum from the centerline location I to the intermediate location II or IV. On the other hand, curve B in FIG. 5 (*c*) illustrates the same situation along the diagonal where the flow resistance is a maximum at position I and decreases to a minimum at the intermediate position III. The use of such flow resistance, varying from a maximum at the centerline location corresponding to maximum gas input from the HII device to a minimum at the intermediate location corresponding to low or zero gas input, ensures that the pressure drop in the flow direction will be minimized. In a more simplified form this embodiment of the invention may be considered as utilizing flow resistance which uniformly decreases from the centerline initial position to an outward radial position. For example, if one considers a uniform HII array (that is the vertical columns and horizontal rows spaced evenly) then a circular device centered at position I and radius such that its circumference passes through II or IV may be utilized for the flow resistance. This essentially means that the flow resistance is graduated from maximum to minimum along that radius and corresponds to the curve A type resistance. Such flow resistance means that the minimum or zero flow resistance point is reached along the diagonal prior to the intermediate point III as illustrated schematically by curve C of FIG. 5 (*c*). Such utilization of radially uniform flow distributors may be satisfactory in that the bulk of the gas is distributed and allows significant intermediate area between adjacent HII units free of flow resistance in the bulk gas flow direction.

In another embodiment of the invention, a flow distributor varying from a maximum to a minimum may be positioned corresponding to each HII unit but graduated from maximum to minimum at a position less than the intermediate points. For example, this would be illustrated by a flow resistor of radius V (see FIG. 5 (*a*)), which is less than any of the intermediate distances as shown by curve D. This approach imposes a maximum flow resistance at the centerline position of the individual HII cone mouth coresponding to the maximum gas flow and which may be graduated downward in suitable fashion to divert flow from the inlet jet in such a fashion that the gas flow is diverted to surrounding areas to obtain uniformity in the flow direction for subsequent introduction to the ESP stage.

The aforedescribed utilization of flow restriction devices imposes flow resistance where needed to divert gas and yet minimizes total flow resistance in the flow direction such that a minimum gas stream pressure drop is introduced between the HII-ESP stages. As will be described hereinafter, many specific flow resistance configurations may be utilized to practice this invention. These devices all satisfy (in varying degrees) the requirements of the present invention from a flow dynamics standpoint and additionally all have desirable characteristics relative to the previously described space charge problems.

Figure 6:
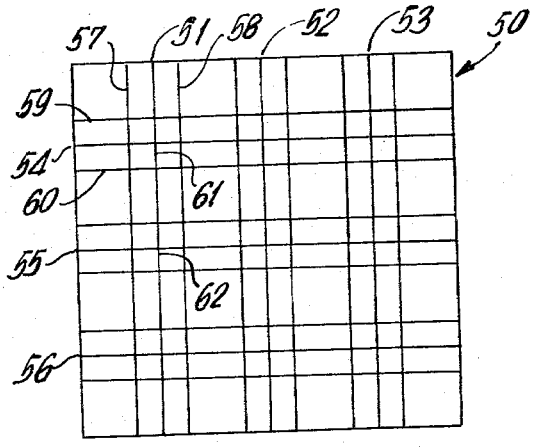
FIG. 6 is an end view of a suitable grid of elongated members suitable for use as the flow restriction means of this invention.

One particular means of practicing the current invention is illustrated in FIG. 6. This flow distribution device consists of an elongated member grid arrangement 50 which introduces flow resistance between the HII and ESP units according to the invention. As illustrated, suitable elongated grid members such as pipe or rod 51, 52 and 53 are arranged in a vertical fashion and aligned with the columns of HII units. Other members 54, 55 and 56 are horizontally aligned and cross the vertical members such that the intersections of the two members, as for example intersections 61 and 62, correspond to the cone mouth centerline position of the HII units of the array. Additional vertical grid members such as 57 and 58 are placed on either side of the center vertical grid members for each column of HII units. In a similar fashion, additional horizontal grid members such as 59 and 60 are placed on either side of the main horizontal grid members for each row of HII units of the array. For the illustrative example concerning a $3\times3$ array of HII units (total of 9 individual units) the arrangement as described results in the utilization of nine vertical grid members and nine horizontal grid members. As can be seen from the diagramatic representation, this arrangement imposes maximum flow distribution at the centerline location of each HII unit with decreasing flow resistance radially outward from that location. Although this embodiment utilizes three vertical and three horizontal grid members associated with each HII unit for illustrative purposes, additional or fewer grid members could be utilized if so desired. Likewise, the spacing of the different grid members on either side or top of bottom of each HII unit is a flexible feature which may be varied as desired according to specific needs. Further, it is not necessary for the grid members to be specifically oriented in intersecting horizontal and vertical fashion as illustrated in FIG. 6. For example, a diamond or triangular pattern HII array could utilize non-right angle grid arrangements.

It is desirable for the individual elongated members to be placed adjacent or even contiguous to each other so that the construction of the flow restriction grid does not introduce sharp contours as might be the case if the members were in the same plane. Additionally, it is expected that a single-plane grid of elongated members would be a more difficult construction technique in that the individual members would need to be suitably joined to one another at many different points. In contrast, if the individual members each extend across the entire grid they may be joined as for example by spot welding, soldering, or suitable adhesive to maintain integrity of the flow grid. It should also be recognized that all elongated members need not have the same diameter. Any configuration of elongated member-type of flow restriction means suitable from an assembly standpoint can be utilized, for example, a form of woven configuration where alternate rows would contain the vertical member on different sides of the cros-member. It is preferred to have all elongated members utilize smoothly contoured ends which may be conveniently hemispherical in shape or any suitable rounded contour which is conveniently fabricated. It is preferred to avoid low radius convex edges, that is, sharp edges, which will serve to concentrate the electric field associated with the dust cloud and thereby lead to destruction of the desirable charge on the dust particles. Typically, the flow resistance devices should preferably not contain convex surface contours of radius less than about $\frac{1}{4}$ inch. Concave edges, even if sharp, do not cause electric field concentration.

From a material standpoint, the elongated members may be fabricated from either suitable metallic materials such as steel, aluminum, or copper or fabricated from suitable non-metallic materials such as plastics. Additionally, the elongated member-type of flow restriction means may be constructed from pipe or rod combinations. The grid forming the flow restriction means may be suitably placed inside the flow cavity between the HII and ESP units by any suitable mounting means such as support tabs or bolts, and such mounting means may thereby ground the grid so that the grid is at neutral electrical potential. Alternatively the grid may be supported in such a fashion that electrical grounding is not part of the mounting means so that the grid assumes the electric potential corresponding to the surrounding charged dust cloud. The grid is mounted between the HII and ESP units in substantially a normal position relative to the gas flow so that the flow grid is uniformly displaced from the array of HII units and similarly from the leading edges of the ESP collecting plates.

Figure 7A:
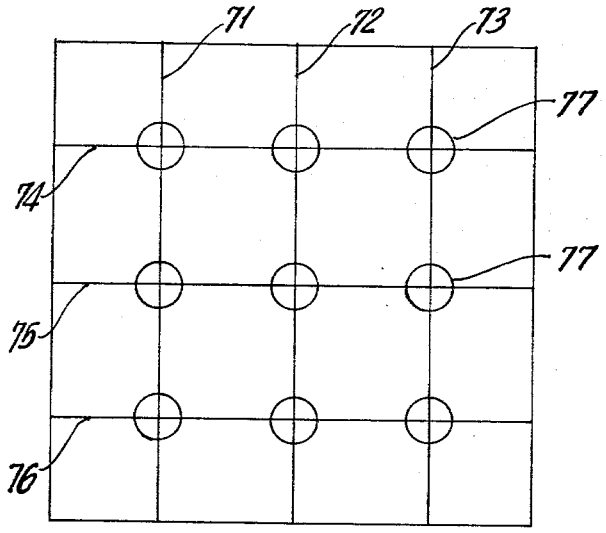
FIG. 7(*a*) is an end view of a suitable assembly of individual flow restriction means paired to individual HII cone mouths for practicing another embodiment of the invention.

Another arrangement for positioning flow restriction means in paired relationship with the individual HII cone mouths and the electrostatic precipitator inlet is shown in the FIG. 7*a* end view. The complete flow distribution structure is formed by the vertical support members 71, 72 and 73 and the horizontal support members 74, 75 and 76 crossing in a pattern such that the intersections of these members corresponds to the centerline axis of the HII discharge cone mouths. These support members which may be suitable tubular or rod members as for example any of those described in connection with FIG. 6, in turn support a number of flow restriction means 77 corresponding to each HII location. The flow restriction means 77 are each associated with an individual HII unit and have the characteristics associated with this invention. Such matched HII units and flow restriction means can assume a variety of forms, for example a round section of screen at each intersection having a circular edge surrounding the screen matrix. The latter may for example comprise uniformly spaced individual vertical and horizontal strand members.

The FIGS. 7 (*b*) enlarged end view illustrates another suitable screen-type of flow restriction means comprising a round section of screen with non-uniform spacing of the matrix members. That is, the round section of screen would be surrounded by suitable tubular or rod circular member 80 and the internal matrix includes a first group of parallel spaced members 81*a*–81*d* with those adjacent to the centerline axis of the HII discharge cone mouth (members 81*a* and 81*b*) more closely spaced to each other than the first group members more distant from the HII centerline axis (members 81*c* and 81*d*). The internal matrix also includes a second group of parallel spaced members 82*a*–82*d* in crossing relationship to the first group 81*a*–81*d* with the second group members adjacent to the HII cone mouth centerline axis (members 82*a* and 82*b*) more closely spaced to each other than the second group membes 82*c* and 82*d* more distant from the centerline axis.

It is not essential that the screen-type matrix members be oriented in vertical or horizontal fashion since the preferably round section may be rotated in any desired manner to achieve the desired cross member orientation—preferably about 90 degrees.

Another suitable construction for the flow restriction means 77 of FIG. 7*a* is a spiral configuration, as for example illustrated in FIG. 7*c*, formed from a longitudinal extended member 83 as for example described in connection with FIG. 6. This configuration is shaped in a continuous circular fashion initiated by the smallest radius 84 adjacent to the center line axis of the mouth of each high intensity ionizer discharge cone. The radius becomes progressively larger, as for example radius 85, until the desired size is obtained. The radius may increase in uniform increments per turn or as illustrated may gradually increase such that the radial difference between adjacent turns increases towards the periphery relative to the HII cone centerline.

The individual flow distribution means, as for example described in connection with FIGS. 7*b* and 7*c*, may be physically attached to the mouth of the individual high intensity ionizer discharge cones as for example illustrated in FIG. 8*a*. This Figure shows a cross-section of an HII unit 100 with its associated cathode disc 101 and electrical connection 102. The gas exits from mouth 114 of the cone 112 at a high velocity and impinges on the non-uniform flow distribution means 105, as for example supported by rod members 106 and 107, aligned parallel to the gas flow path. The cross-sectional end views of FIGS. 8*b* and 8*c* (taken along lines A—A and B—B respectively of FIG. 8*a*) illustrate suitable individual mounting means. As shown in FIG. 8*b*, the rod-type flow device support means 106 and 107 may be attached in any suitable fashion such as metal bonding to the HII cone mouth 114 associated with each individual HII unit 100. Alternatively, members 106 and 107 may be attached to the ESP plates for support. The other end of the rod support members 106 and 107 would be suitably attached, as for example by metal bonding, to an outer portion of the flow restriction means 105 as shown in FIG. 8*c*. As illustrated in FIG. 8*c*, the flow distribution means 105 has essentially the same outer diameter as the HII cone mouth 114, but this is not essential. In its broadest aspect, the effective diameter of the flow restriction means is between ½ and 2 times the diameter of the cone discharge mouth, and preferably between ¾ and 1¼ times the cone discharge mouth diameter.

The invention will be more clearly understood by illustrative dimensions for the flow distribution means in terms of the dimensions of the individual high intensity ionizer units. Typically the high intensity ionizer units have a gas discharge cone mouth of diameter between 12 inches and 36 inches, for example about 22 inches. The number of individual HII units range from a single unit to an array of 12×12 with typical assemblies being 3×10 or 3×5 units. The gas flow from these multiple HII units normally exits from the cone mouth at velocity between 12 ft/sec. and 30 ft/sec., typically about 20 ft/sec. As previously discussed, the flow distribution devices must equalize the gas flow from the substantially individual source points across the entire flow area so that the gas velocity is between about 4 ft/sec. and 6 ft/sec. and uniformly distributed.

As previously explained, the elongated member grid configuration of FIG. 6 has a set of main members which intersect at points in longitudinal alignment with the cone mouth of each HII unit, and additional elongated members are spaced from each main member as desired to form the flow resistance. Each elongated member may for example have a diameter between ½ inch and 4 inches. The area of this grid forming the flow resistance region for a particular HII unit is the circular area based on the longitudinal centerline of the HII enlarged cone discharge mouth as its center. The "effective diameter" is only sufficiently large to include the outermost extremities of all crossing elongated members within each area. In the practice of this invention, the open area of this flow restriction means is between 5% and 50%. Also, the effective diameter of this flow restriction means is between ½ and 2 times the diameter of the cone mouth.

Figure 7B:
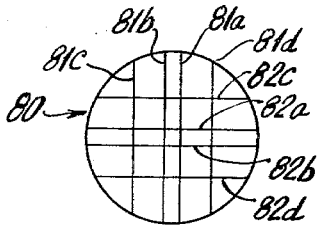
Figure 7C:
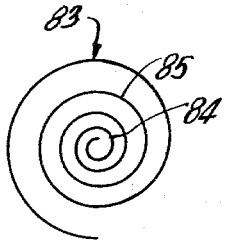
Figure 8A:
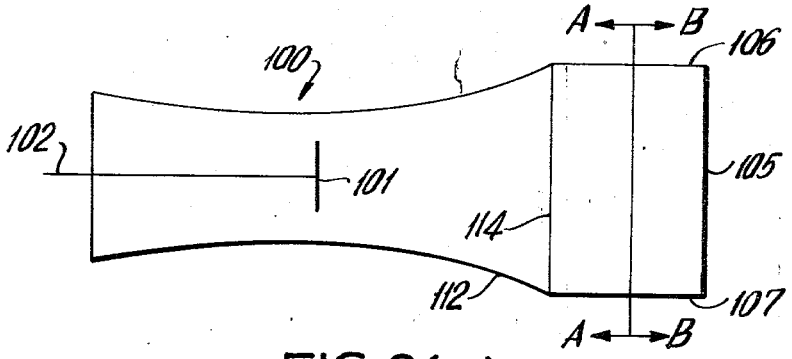
FIG. 8(*a*) is a schematic drawing taken in cross-section elevation of an individual HII unit with an individual spiral-type flow restriction means attached to the HII mouth.
Figure 8B:
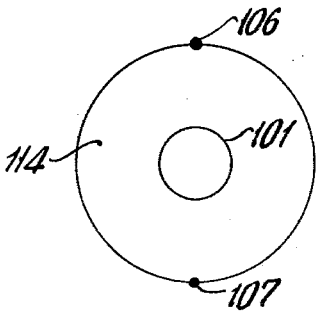
Figure 8C:
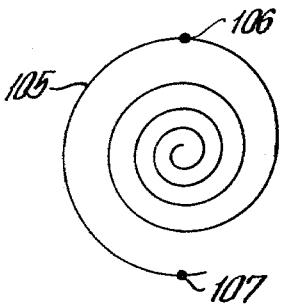

For the FIGS. 7*a*–F*c* types of multiple flow restriction flow means each paired to an individual HII unit, the outer (effective) diameter of the FIG. 7(*b*) screen and FIG. 7(*c*) spiral configurations is between ½ and 2 times the diameter of the HII cone mouth, and may for example be supported by vertical and horizontal members constructed of fairly heavy stock rod of diameter between 1 inch and 3 inches in both directions. Spacing of the FIG. 7(*b*) screen member individual strands may for example range from ¼ inch to 2 inches in both directions. The tube or rod member used to construct the spiral embodiment may range from a diameter of 1 inch to as much as 3 inches. The spacing of the spiral is preferably such that the inner end of the spiral intersects the centerline of the matched HII unit and may uniformly increase in radius such that the delta radius at any point is equivalent to the diameter of the member used to construct the spiral. Suitable ranges for such deltas are from ½ the diameter of the member to as much as 3 times the diameter of the member. As illustrated in FIG. 7(*c*), the spiral radius may increase in a non-uniform manner such that each successive increment between adjacent members increases. The spiral may be constructed such that each spacing (of adjacent member of any radial line) is from 1½ to 2 times the previous increment. A preferred embodiment for the increasing spiral radius utilizes a spacing ratio of about 1.5. The overall diameter of the spiral member would be such that it could be from ½ the diameter of the HII cone mouth to twice this diameter.

Another physical dimension related to practice of this invention is the longitudinal placement of the flow restriction means between the HII and ESP units. It is expected that the placement of such flow restriction means would be in the transverse plane substantially parallel to the transverse plane containing the gas exit cone mouths of the HII array. This plane may be as close as 3 inches to either the exit of the HII cones or the inlet of the ESP precipitator. On the other hand, the longitudinal distance of the flow restriction means between each of the HII and ESP units may be up to about 12 inches for severe flow distribution duty, that is, relatively few HII units compared to the cross-sectional area of the ESP unit. A preferred placement for the flow restriction means transverse plane is about 6 inches from both the HII and ESP stages.

Figure 9A:
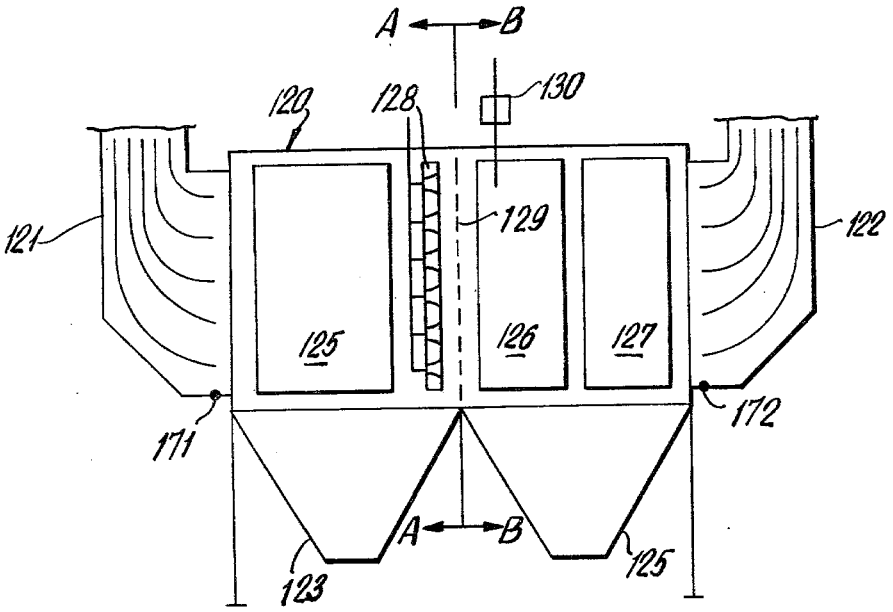
FIG. 9(*a*) is a schematic drawing taken in cross-section elevation of an experimental HII-ESP assembly used to demonstrate the invention.

The method and apparatus of this invention were demonstrated in an experimental HII-ESP system schematically illustrated in the cross-section elevation view of FIG. 9*a*. The flow distribution tests were conducted on a scale model system which combined three ESP units and an HII array all combined with various flow restriction devices therebetween. The experiments were conducted on a 1/10th scale model in order to maintain geometric flow similarity for the test unit compared to a contemplated full-size installation. As shown in FIG. 9*a*, this experimental system 120 included a gas inlet 121, three simulated ESP units 125, 126 and 127 and an exit gas passage 122. System 120 also included dust collection hoppers 123 and 125 to ensure a complete simulation of fluid flow behavior for the system. Since the flow test model was utilized only to simulate the flow behavior of a full-sized system, ambient air was processed in the system and electrical connections to the HII unit were not made. As shown in FIG. 9*a*, the HII array 128 was placed between the first ESP unit 125 and the second ESP unit 126 and flow restriction means 129 was placed between the HII array 128 and the second downstream ESP unit 126.

Figure 9B:
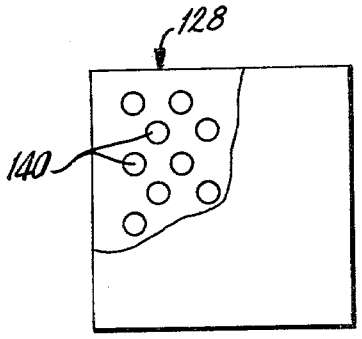
Figure 9C:
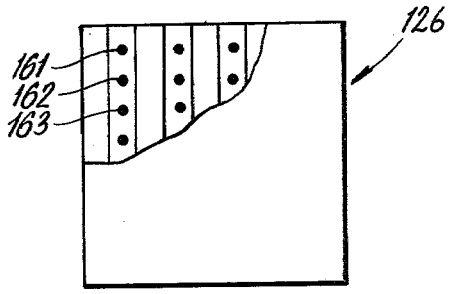
Figure 10:
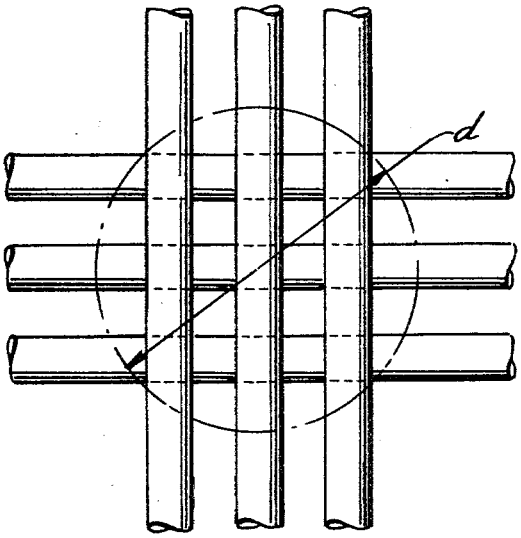
FIG. 10 is an end view of a rod-type flow restriction means arranged in a square pitch matrix as used in tests with the FIG. 9 HII-ESP assembly.
Figure 11:
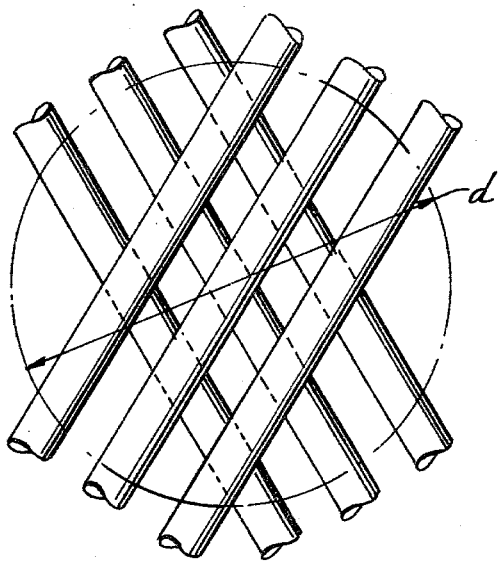
FIG. 11 is an end view of a rod-type flow restriction means arranged in a triangular pitch matrix as used in tests with the FIG. 9 HII-ESP assembly.
Figure 12A:
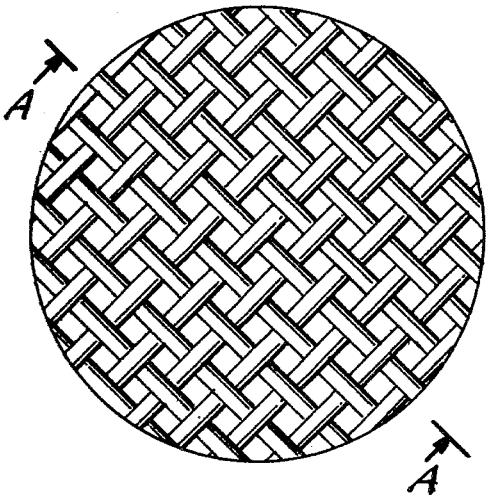
FIG. 12(*a*) is an end view of the screen type of flow restriction means as used in tests with the FIG. 9 HII-/ESP assembly.
Figure 13:
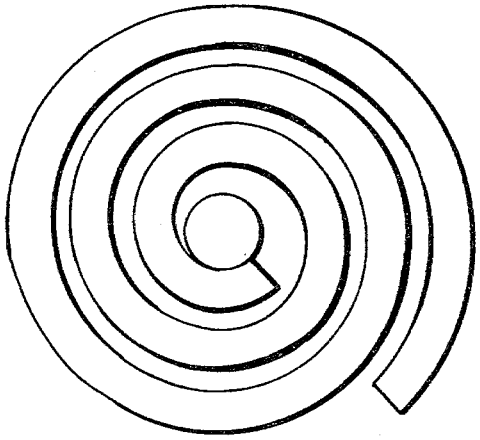
FIG. 13 is an end view of the spiral rod flow restriction means used in tests with the FIG. 9 HII-ESP assembly.
Figure 12B:
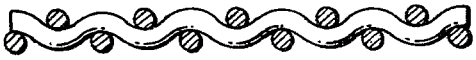

During flow testing of the scale model system 120, velocity measurements were made in a regular pattern throughout the second downstream ESP unit 126 as better understood by cross-sectional end views taken along line A—A as FIG. 9*b*, and along line B—B as FIG. 9*c*. The FIG. 9*b* view of the HII array 128 illustrates a typical triangular pitch arrangement of the individual HII units 140. The FIG. 9*c* view of the second downstream ESP unit 26 illustrates the parallel flow channels formed by the simulated plates of the ESP. During the flow tests, an automated hot wire anemometer 130 was positioned within the second downstream ESP unit 126 and programmed to automatically record gas velocity information. The anemometer instrument 130 was mounted on a track which automatically moved the device to alternate flow channels across the ESP unit 126 and for each channel moved the recording device vertically downward. Although the instrument moved continuously, readings were taken at locations such as 161, 162 and 163 to obtain uniformly spaced gas velocity measurements vertically distributed within the given flow channel. The combination of such multiple velocity readings was then utilized to calculate a standard deviation of the gas flow distribution. This standard deviation then became a meaningful measure of the velocity distribution across the entire flow area associated with the ESP unit. Pressure drop measurements across the entire combined HII and ESP unit were also obtained during these tests by appropriate probes located at the inlet duct position 171 and the outlet duct position 172. Comparison of such pressure drop measurements for the various flow restriction devices (and base test without any flow restriction) combined with the standard deviation measuremens was used to assess the performance improvement associated with this invention.

Flow restriction tests were performed with two different HII devices. The first HII device had smooth surfaces throughout the throat and exit cone regions. The diameter of the throat was $1\frac{1}{4}$ inches whereas the diameter of the exit cone mouth was $1\frac{7}{8}$ inches. Further tests were performed utilizing another small scale HII device which simulated mechanical and flow conditions associated with the use of an air-purged vaned anode as described for example in Satterthwaite U.S. Pat. No. 4,108,615. This scale model device was similar to the smooth surface scale model except that it utilized a 40 mesh-7 mil diameter wire screen positioned in the throat region of the HII unit. During the flow restriction tests a purge air portion approximating 1/10th of the total process air was introduced through the screen area in order to simulate the expected hydrodynamic condition in the vaned anode. The HII arrays tested included individual ionizer units on both rectangular and triangular opening or open area patterns as detailed in Table 1, along with other pertinent test condition parameters.

TABLE 1

| Flow Restriction Test Conditions | |
|---|---|
| Flow Model Scale | 1/10 |
| ESP Cross-Section | 3.1 ft. height<br>3.2 ft. width |
| ESP Parallel Ducts (Number of) | 40 |
| Duct Spacing | 0.9 Inch |
| HII Arrays (Number and Arrangement) | 110 ionizers on $3\frac{3}{4}$ inch center to center horizontal direction by 3 5/16 inch center to center vertical direction, defining rectangular openings or open areas<br>114 ionizers on $3\frac{3}{4}$ inch center to center horizontal direction by $3\frac{1}{8}$ inch center to center vertical direction, defining triangular openings or open areas |
| Flow Restriction Means Position Distance from HII Array Exit Plane | 0.6 inch |
| Distance from ESP Array Entrance Plane | 0.6 inch |
| Flow Velocity Data Positions | Alternate flow channels across and even vertical distribution (20 × 26 for 520 or 20 × 52 for 1040 points) |
| Air Flow | 2200 to 3800 actual cubic feet per second |
| Ambient Conditions | 25° C.<br>14.6 pounds per square inch absolute |

Flow distribution tests were performed for a variety of conditions including base conditions associated with the use of the HII array without a flow restriction device and then followed by several different flow restriction device tests including rod grids, screens, and spiral coils. The particular flow device conditions and arrangements are illustrated in FIGS. 10 through 13 and Table II. The effective diameter of the flow restriction means is shown by a dashed circle (d) for the grid configurations whereas the effective and device diameters are the same for the screen and spiral configurations. For the FIG. 10 square opening or open area elongated member matrix as schematically illustrated in FIG. 6 and in the form of $\frac{3}{8}$-inch diameter rods spaced $\frac{1}{2}$ inch center-to-center, the effective diameter is $2\frac{1}{8}$ inch. For the FIG. 11 triangular opening or open area matrix using the same rods spaced $\frac{1}{2}$ inch center-to-center and oriented 59 degrees from the horizontal position, the effective diameter is $2\frac{3}{4}$ inches. For the FIGS. 12*a* and 12*b* screens, the overall width (from outer surface of underlying strands to outer surface of overlying strands) is 0.240 inch, the opening between adjacent wires in the transverse direction is a square of 0.165 inch length, and the effective diameter is 2.875 inch. For the FIG. 13 spiral coil configuration with an equal gap between all adjacent spirals, a ½ inch diameter circular slug was positioned at the center and the effective diameter was 3 inches.

TABLE II

| Type (and FIG. 14 curve identity) | Flow Restriction Devices: Description | Diameter Ratio* | Open Area %: Device (d) | Open Area %: Overall |
|---|---|---|---|---|
| Rod Grids (K) | ⅜" Rod defining Square Openings or Open Areas (6 Rods for each HII Spaced at ½") | 1.1** | 14 | 38 |
| | ⅜- Rod defining Triangular Openings or Open Areas (6 Rods for each HII at ½" Spacing) | 1.5** | 27 | 38 |
| Single Screen (L) | 3½ Mesh with 0.120" Wire | 1.5 | 34 | 60 |
| Spiral (M) | ¼" Diameter Aluminum Rod with ⅜" Gap | 1.6 | 35 | 61 |
| Double Screen (L) | 3½ Mesh with 0.120" Wire with Overlay | 1.5 | 6.5 | 43 |

Figure 14:
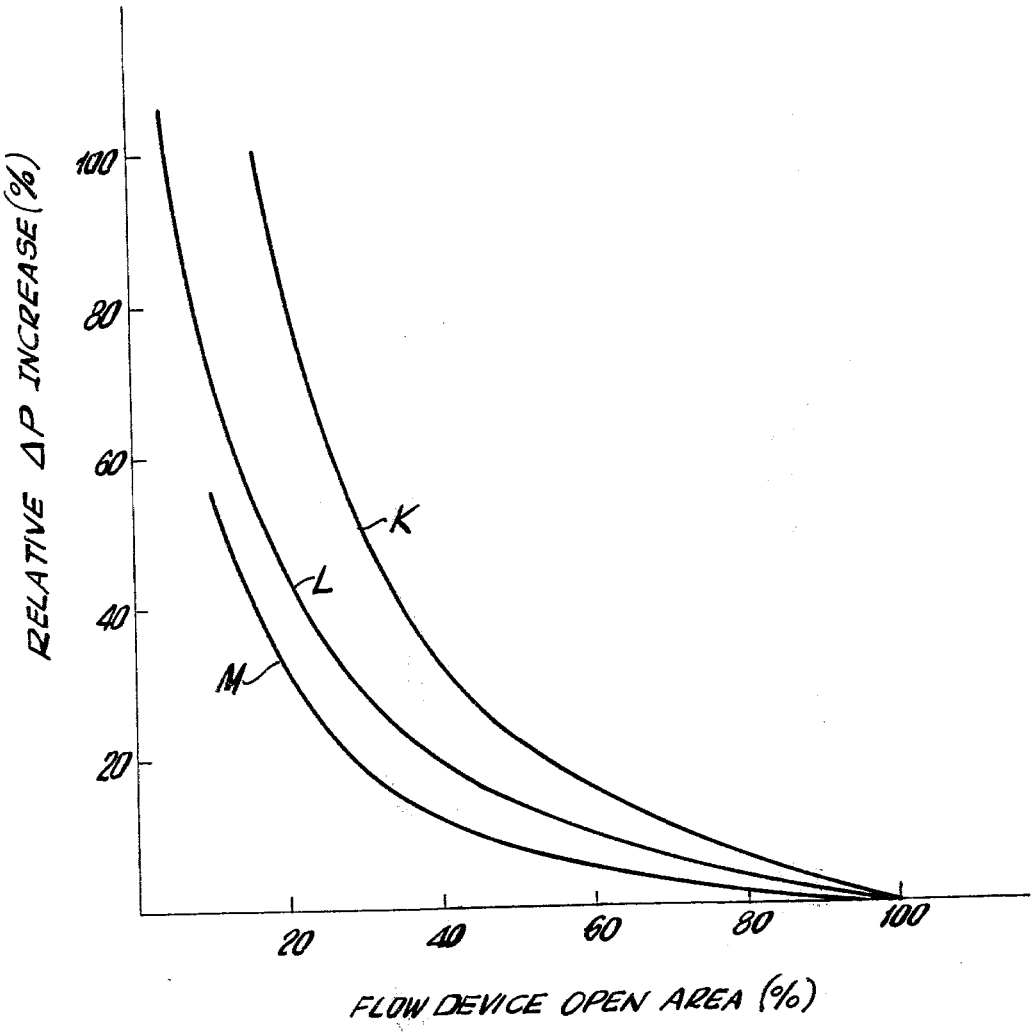
FIG. 14 is a graph showing the relative pressure drop increase as a function of the percent open area for the FIGS. 10–13 flow restriction means.
Figure 15:
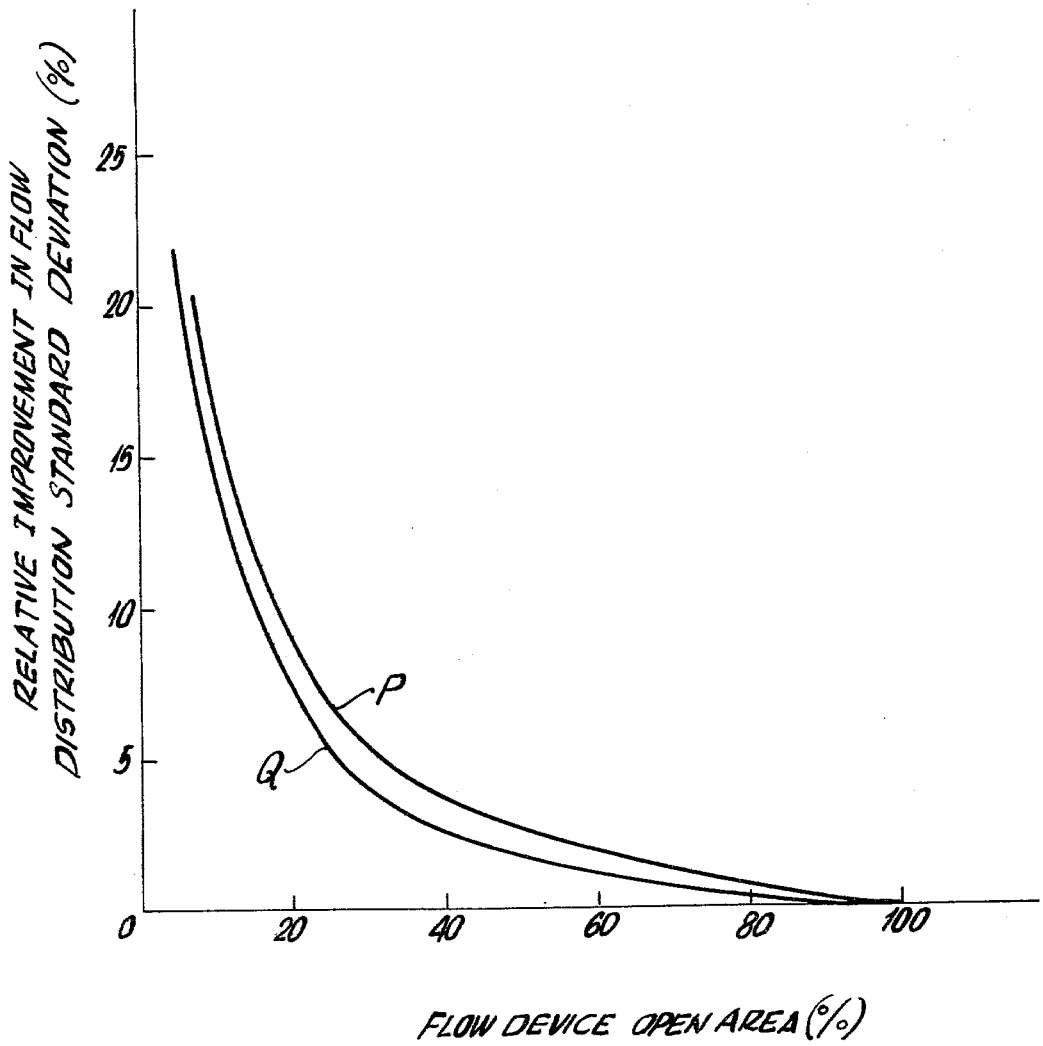
FIG. 15 is a graph showing relative improvement in standard deviation as a function of percent open area for both the smooth throat and vaned anode types of HII devices.

*Based on HII Exit Mouth Diameter
Based on Circular Area Including all Cross-members As previously noted, the test results were in the form of pressure drop and standard deviation measurements. For useful comparisons relative to the performance influence associated with the various tested flow restrictions means, the graph of FIGS. 14 and 15 summarize experimental results on the basis of a relative pressure drop and standard deviation improvement. Such testing considered the system pressure drop and flow distribution standard deviation without any flow restriction device as the base condition. Additional tests utilizing each of the particular flow restriction devices measured both the increased pressure drop and the improvement in velocity distribution as represented by the standard deviation measurement. The data from these tests is also summarized in FIGS. 14 and 15**.

FIG. 14 shows the relative pressure drop increase as a function of the open area for the flow restriction device. On the graph, the 100% point represents this relationship without any flow restriction device and the various curves are based on points at less than 100% as documented in Table II. The test data illustrates that the rod grid (curve K) resulted in higher measured pressure drop increases than the single screen or double screen (curve L) and the spiral coil (curve M). This information indicates that from a hydrodynamic fluid pressure drop standpoint only, the spiral coil is preferable to either of the other two devices as having the lowest pressure drop for a particular percent open area. The experimental data also indicates that use of flow restriction devices such as the screens or spiral coils is preferable to the rods in that the increased pressure drop at any given open area value is reduced. These results are consistent since the screen and spiral coil devices do not present flow resistance between the individual HII units as do the rod grids.

Although the pressure drop information is a measure of the power penalty associated with the use of the flow restriction devices pursuant to this invention, the performance benefits of such flow restriction devices are illustrated in FIG. 15. This diagram again presents the experimental data in graphical fashion showing relative improvement in standard deviation as a function of open area. Again, open area of 100% represents the condition without any flow restriction device. This Figure presents results including the tests for a variety of HII conditions including the previously specified smooth throat device (curve P). Curve Q represents HII device operation with purge air simulating the expected flow behavior of an actual vaned cathode device. FIG. 15 illustrates that the flow restriction improvement increases as the open area decreases and also is related to HII throat conditions. The graphs indicate that for both HII throat conditions, as the open area decreases (thereby offering additional flow resistance to the exiting fluid from the HII device) the improvement in flow distribution is increased. As can be seen from the curves approximating the particular experimental points measured, decreasing open area to levels less than about 20% results in very significant improvements in flow distribution.

The experimental results as represented by FIGS. 14 and 15 support the aforedescribed parameter limits of this invention. From the pressure drop results, it can be seen that introducing flow restriction devices of the different types and with differing open areas leads to significant pressure drop increases at open areas of less than about 50%. The data also indicates that use of flow restriction devices with open areas of less than 5% would increase the pressure drops by about 100%. However, examination of the improvement in standard deviation of the flow restriction, as represented by FIG. 15, illustrates that improved flow distribution occurs only at the lower range of open areas. Thus, for example, the tests verify that open areas of 50% or greater have relatively minor improvement in standard deviation whereas open areas of 5% or less have significant improvement but at the expense of considerable pressure drop. As previously stated, the broadest method and apparatus aspects of this invention require the use of flow restrictions with between 5% and 50% open area. The preferred range of such open areas is between 5% and 20% as representing significant improvement in flow distribution at reasonable pressure drop penalties.

Even though the previously described experimental results did not include particulate laden gas being treated by the electrical discharges associated with the HII unit, it is believed that the fluid distribution and pressure drop data obtained is representative of full-size operation for removal of particles from gas streams.

Although the test results were concerned with flow distribution (restriction) measurements, the ultimate advantage of the invention is related to improved HII-/ESP performance. Based on the correlations of "A Mathematical Model of Electrostatic Precipitation", J. R. McDonald, Modelling and Programming Vol. 1, pg. 31, EPA Report No. 60017-78-1116, June 1978, it is estimated that for typical ESP units with a base collection efficiency of 98%, an improvement of 10% in the flow distribution standard deviation is equivalent to about 7% improvement in particulate removal.

Although preferred embodiments of the invention have been described in detail, it will be appreciated that other embodiments are contemplated, along with modifications of the disclosed features, as being within the scope of the invention. For example, as used herein the term plate-wire electrode type electrostatic precipitator is used to broadly describe any of the well-known designs of single-stage electrostatic precipitators in which the discharge electrode may take the form of thin members with circular, square or other cross-section, barbed configuration or thin strips of metal which may be stamped or formed into various shapes. Various shapes of suitable wire electrodes for practicing this invention are, for example, described in "The Electrostatic Precipitator Manual", published by the McIllvaine Company, Northbrook, Ill., Vol. 1, Chapter III, page 2.04.

In a similar fashion, the expression plate electrode for an electrostatic precipitator should not be limited to flat plates but may also encompass rippled or corrugated plates. Additionally, such electrodes usually include a plurality of approximately shaped fins which extends into the gas flow channel and are designed to keep particle reentrainment losses at a minimum, as is well-known to one of ordinary skill.

What is claimed is:

1. In a method for removing particles from a feed gas stream in which the particles entrained in said feed gas stream are electrostatically charge by passage through a flow restricted high intensity discharge throat-shaped region and thereafter passed through an enlarged cone-shaped discharge region, with a multiplicity of such throat-shaped and enlarged cone-shaped discharge regions being transversely positioned in the feed gas flow path and spaced from each other such that each particle passes through one throat-shaped region and one cone-shaped region, each cone-shaped discharge region having a discharge mouth with all such discharge mouths being in the same transverse plane, and the electrostatically charged particles are thereafter collected in a downstream plate-wire electrode type electrostatic precipitation step, the improvement comprising: providing an open gas flow restrictor opposite each discharge mouth so as to restrict the gas flow containing electrostatically charge particles entering said electrostatic precipitation step and with each flow restrictor defining a restriction having an effective diameter, disposing the flow restrictors normal to the gas flow direction and in a single transverse plane substantially parallel to and longitudinally displaced from the discharge mouth transverse plane such that the open area of each gas flow restrictor is between 5% and 50%, with the effective diameter of each restriction being between ½ and 2 times the diameter of the respective enlarged cone-shaped discharge mouth, and with each restriction in the longitudinal centerline region of said flow restrictors being at least as high as the restriction in the circumferential region of such flow restrictor.

2. A method according to claim 1 in which the flow restriction is maximized in said longitudinal centerline region of said flow restrictor and thereafter progressively diminishes to said circumferential region of said flow restrictor.

3. A method according to claim 1 in which the flow restriction is uniform within its cross-sectional area.

4. A method according to claim 1 in which the open area of the flow restrictor is between 5% and 20%.

5. A method according to claim 1 in which the effective diameter of each restriction is between ¾ and 1¼ times the diameter of the respective enlarged cone-shaped discharge mouth.

6. In apparatus for removing particles from a feed gas stream including a multiplicity of high intensity ionizers each comprising a tubular Venturi means with a throat section having a disc-shaped member as a cathode positioned within said throat section and the inner wall of said throat section as the anode and an enlarged downstream cone-shaped discharge region having a discharge mouth in the feed gas flow path, with said high intensity ionizers being transversely positioned in said feed gas flow path and transversely spaced from each other with all discharge mouths being in the same transverse plane such that each particle passes through one high intensity ionizer, an electrostatic precipitator having an inlet in gas flow relation with the discharge mouths of said high intensity ionizers and comprising parallel spaced plates and a multiplicity of wires equally spaced between each pair of adjacent plates and positioned at intervals in the longitudinal flow direction from the electrostatic precipitator inlet to a gas discharge end and oriented with the wire length normal to the direction of gas flow, the improvement comprising: a flow restriction means disposed opposite each discharge mouth between the high intensity ionizer discharge mouths and the electrostatic precipitator inlet, with each restriction means defining a restriction having an effective diameter, each restriction means being formed from multiple elongated and small cross sectional area members positioned normal to the gas flow direction, at least some of said members being spaced from each other and all lying in a single transverse plane substantially parallel to and longitudinally displaced from the discharge mouth transverse plane, and having between 5% and 50% open area with the effective diameter of the restriction being between ½ and 2 times the diameter of the discharge mouths, and with the percent open area in the longitudinal centerline portion of said flow restriction means no higher than the percent open area in the circumferential portion of said flow restriction means.

7. Apparatus according to claim 6 in which the percent open area is respectively the smallest in the longitudinal centerline portion of said flow restriction means and highest in the circumferential portion of such means.

8. Apparatus according to claim 6 in which the spaced elongated members are positioned such that a first group are aligned in parallel relationship to each other with axes in front of the high intensity ionizer discharge mouths.

9. Apparatus according to claim 8 in which said first group of elongated members comprises a first series positioned to intersect the centerline axis of said high intensity ionizer discharge mouths, a second series transversely spaced from said first series on one side of said centerline axis, and a third series transversely spaced from said first series on the opposite side to said one side of said centerline axis.

10. Apparatus according to claim 8 in which said first group of elongated members comprises a first series positioned to intersect the centerline axis of said high intensity ionizer discharge mouths, a second series transversely spaced from said first series on one side of said centerline axis, and a third series transversely spaced from said first series on the opposite side to said one side of said centerline axis; and a second group of elongated members are aligned in parallel relationship to each other and in intersecting relationship with said first group.

11. Apparatus according to claim 6 in which said elongated members form a screen means positioned at each high intensity ionizer discharge mouth.

12. Apparatus according to claim 11 in which said screen means comprises a first group of parallel spaced members with the members thereof adjacent to the centerline axis of said high intensity ionizer discharge mouths being more closely spaced to each other than the first group members more distant from said centerline axis, and a second group of parallel spaced members in crossing relationship to said first group with the second group members adjacent to said centerline axis more closely spaced to each other than the second group members more distant from said centerline axis.

13. Apparatus according to claim 6 in which said elongated members cooperate to form a spiral configuration positioned such that the smallest radius is adjacent to the centerline axis of each discharge mouth.

* * * * *

UNITED STATES PATENT AND TRADEMARK OFFICE

CERTIFICATE OF CORRECTION

PATENT NO. : 4,251,234

DATED : February 17, 1981

INVENTOR(S) : Ching M. Chang

It is certified that error appears in the above-identified patent and that said Letters Patent are hereby corrected as shown below:

In col. 1, line 37, "particulated" should read -- particulates --.

In col. 4, line 7, after "centerline of" insert -- the --

In col. 4, line 22, "highly" should read -- high --.

In col. 4, line 68, "test" should read -- tests --.

In col. 7, line 8, "continuous" should read -- conditions --.

In col. 9, line 46, "of" (first occurrence) should read -- or --.

In col. 10, line 59, "FIGS." should read -- FIG. --.

In col. 12, line 24, "Fc" should read -- 7c --.

In col. 15, line 11, in Table II under Description, "3/8" Rod defining" insert the word -- Rectangular --.

UNITED STATES PATENT AND TRADEMARK OFFICE

CERTIFICATE OF CORRECTION

PATENT NO. : 4,251,234

DATED : February 17, 1981

INVENTOR(S) : Ching M. Chang

It is certified that error appears in the above—identified patent and that said Letters Patent is hereby corrected as shown below:

In col. 15, line 16, in Table II under Description, "3/8-" should read -- 3/8" --, and the word -- Square -- should be inserted after "Triangular" in line 17.

Signed and Sealed this

Ninth Day of June 1981

[SEAL]

*Attest:*

RENE D. TEGTMEYER

*Attesting Officer*

*Acting Commissioner of Patents and Trademarks*